US008485879B2

(12) United States Patent
Lin et al.

(10) Patent No.: US 8,485,879 B2
(45) Date of Patent: Jul. 16, 2013

(54) FIGHT ANALYSIS SYSTEM

(75) Inventors: Michael T. Lin, San Francisco, CA (US); Mitchell Heinrich, San Francisco, CA (US); Jonathan Thomas, San Francisco, CA (US); John Pelochino, Redwood City, CA (US); Akbar Dhanaliwala, San Francisco, CA (US); Brian Krieger, San Francisco, CA (US); Felix Dashevsky, New York, NY (US); Jason McCarthy, Haverstraw, NY (US)

(73) Assignee: Jason McCarhy, Haverstraw, NY (US)

( * ) Notice: Subject to any disclaimer, the term of this patent is extended or adjusted under 35 U.S.C. 154(b) by 0 days.

(21) Appl. No.: 13/587,581

(22) Filed: Aug. 16, 2012

(65) Prior Publication Data

US 2012/0310390 A1 Dec. 6, 2012

Related U.S. Application Data

(62) Division of application No. 12/647,148, filed on Dec. 24, 2009, now abandoned.

(51) Int. Cl.
*A63F 9/24* (2006.01)
*A63F 13/00* (2006.01)

(52) U.S. Cl.
USPC ..... 463/8; 463/47.1; 463/47.2; 463/47.3; 463/47.4; 463/47.5; 463/47.6; 463/47.7; 273/455; 473/518; 473/570; 482/83; 482/88

(58) Field of Classification Search
USPC ..... 463/8, 47.1–47.7; 273/455; 473/518, 473/570; 482/83, 88
See application file for complete search history.

(56) References Cited

U.S. PATENT DOCUMENTS

| | | | | |
|---|---|---|---|---|
| RE29,765 | E | 9/1978 | Crane et al. | |
| 4,761,005 | A | 8/1988 | French et al. | |
| 4,824,107 | A * | 4/1989 | French | 273/454 |
| 5,354,057 | A | 10/1994 | Pruitt et al. | |
| 5,723,786 | A * | 3/1998 | Klapman | 73/379.04 |
| 6,162,123 | A | 12/2000 | Woolston | |
| 6,508,747 | B1 * | 1/2003 | Cook | 482/83 |
| 6,612,968 | B1 | 9/2003 | Alvaro | |

(Continued)

FOREIGN PATENT DOCUMENTS

| | | |
|---|---|---|
| JP | 2000-042162 | 2/2000 |
| JP | 3114106 | 9/2005 |

(Continued)

OTHER PUBLICATIONS

International Search Report & Written Opinion, Application No. PCT/US2010,062060, Applicant, McCarthy, Jason et al., Mailed Sep. 15, 2011, 9 pages.

*Primary Examiner* — Arthur O. Hall
*Assistant Examiner* — Jasson Yoo
(74) *Attorney, Agent, or Firm* — Hiscock & Barclay LLP

(57) ABSTRACT

A fight analysis system to objectively determine the quality and quantity of strikes in a fight. In one exemplary embodiment, one fighter wears a receiving module having a plurality of passive RFID tags at different locations that are read by a striking module (e.g., a knife) when the striking module lands on, or comes in proximity to, the receiving module, to provide the location of a strike. Force sensors in the striking module enable determination of the type and force of a landed strike. A graphical user interface module displays information gathered by the fight analysis system.

19 Claims, 7 Drawing Sheets

U.S. PATENT DOCUMENTS

| | | | | |
|---|---|---|---|---|
| 6,669,601 | B2 | 12/2003 | Marciano | |
| 6,677,917 | B2 | 1/2004 | Van Heerden et al. | |
| 6,700,051 | B2 | 3/2004 | Aldridge | |
| 6,714,133 | B2 | 3/2004 | Hum et al. | |
| 6,925,851 | B2 | 8/2005 | Reinbold et al. | |
| 7,165,971 | B2 | 1/2007 | Emricson | |
| 7,516,643 | B2 | 4/2009 | Valentini | |
| 2002/0037759 | A1 * | 3/2002 | Aldridge | 463/1 |
| 2004/0204240 | A1 * | 10/2004 | Barney | 463/36 |
| 2005/0266935 | A1 | 12/2005 | Mabry et al. | |
| 2006/0273907 | A1 | 12/2006 | Heiman et al. | |
| 2006/0273909 | A1 | 12/2006 | Heiman et al. | |
| 2007/0135243 | A1 | 6/2007 | LaRue et al. | |
| 2007/0178967 | A1 | 8/2007 | Rosenberg | |
| 2008/0014835 | A1 | 1/2008 | Weston et al. | |
| 2008/0153594 | A1 | 6/2008 | Zheng | |
| 2008/0153634 | A1 | 6/2008 | Welch | |
| 2008/0188310 | A1 | 8/2008 | Murdock | |
| 2008/0191864 | A1 | 8/2008 | Wolfson | |
| 2008/0220693 | A1 | 9/2008 | Cuisinier | |
| 2009/0003136 | A1 | 1/2009 | Karr | |
| 2009/0029806 | A1 | 1/2009 | Hsu | |
| 2009/0111582 | A1 | 4/2009 | Schuler et al. | |
| 2009/0111616 | A1 | 4/2009 | Creelman | |

FOREIGN PATENT DOCUMENTS

| | | |
|---|---|---|
| KR | 20-0446527 | 11/2009 |
| WO | WO-90-09218 | 8/1990 |
| WO | WO 2007/001145 | 1/2007 |
| WO | WO 2007011145 A1 * | 1/2007 |

* cited by examiner

FIGHT ANALYSIS SYSTEM

CROSS-REFERENCE TO RELATED APPLICATIONS (IF NECESSARY)

This application is a divisional of U.S. patent application Ser. No. 12/647,148, filed Dec. 24, 2009, and entitled Fight Analysis System, the entirety of which is incorporated herein by reference.

BACKGROUND OF THE INVENTION

The subject matter disclosed herein relates to a fight analysis system.

In various forms of fighting (e.g., boxing, martial arts, fencing, criminal attacks, etc.), the success or survival of a fighter is generally determined by the quantity and quality of landed strikes inflicted by and received by that fighter (e.g., punches by a boxing glove in a boxing match, stabs by a knife in a knife fight, or a cut by a sword in a fencing match). The quality of a landed strike can be assessed by determining the type of strike and the force with which the strike landed on the other fighter as well as the location of the strike. For example, a strike landed with a particular amount of force to a particular point on the jaw of a fighter may be more effective than a strike landed with less force to the same point on the jaw of that same fighter. Similarly, a strike landed with a particular amount of force on the forearm of a fighter may be less effective than a strike landed with the same amount of force delivered to the throat of that same fighter.

In most competitive fights, judges determine the quantity and quality of landed strikes based solely on what they can perceive with the naked eye, leaving significant room for human error and mistake. For example, a judge may not be able to see certain landed strikes if his view is obstructed by one of the fighters and therefore may not give a fighter credit for that landed strike. Furthermore, even if a judge is able to see a landed strike, it is often difficult to accurately assess the quality of that strike since that assessment is based primarily on a subjective determination by the judge of the force with which the strike landed. Moreover, in training fighting designed to assess the progress or level of a fighter (e.g., sparring in boxing, testing in martial arts, or defending against a simulated attack in self-defense training), judges are often not available provide indications of the quantity and quality of landed strikes.

In attempting to make scoring of fights more objective, existing solutions include equipment to be worn by the fighters that contain switches or other contacts to indicate the occurrence and location of a landed strike. For example, in fencing, both fighters wear equipment around their torso that can provide an indication when the sword of one fighter has contacted another fighter. These existing solutions, however, typically require that the fighters wear a significant amount of equipment and wiring, decreasing the mobility of the fighters. Also, these existing solutions generally provide information about the occurrence and location of a landed strike, but not necessarily the type of strike and the force with which the strike landed.

In training fighting (e.g., self-defense training), fighters are often required to simulate aspects of a real-fight. For example, the training of a fighter to defend himself against another fighter wielding a knife will involve the use of a fake knife. For the safety of the fighter being trained, the fake knife is typically constructed in such a way that will not inflict significant harm to the fighter being trained (e.g., knife that provides an electric shock to, or marks the clothing of, the fighter stabbed with the knife). However, these safety measures also diminish the reality of the simulation, and therefore diminish the quality of the training. In addition, these simulated fights cannot provide realistic feedback on the actual affect such a landed strike might have on a fighter to better simulate aspects of a real fight. For example, a knife strike to the throat of a fighter would cause more damage (e.g., blood loss) than that same knife strike to the forearm of that same fighter, which would affect the fighter's ability after receiving that strike. Similarly, a strike with a fake knife that does not inflict harm on a fighter does not provide any feedback on the actual force that such a strike would have delivered, diminishing the simulation.

Accordingly, there is a need to provide fight analysis that would objectively determine the quality and quantity of landed strikes without the need to wear a significant amount of equipment and wiring. In addition, there is a need to provide fight simulations that provide a more realistic assessment of a fight.

BRIEF DESCRIPTION OF THE INVENTION

A fight analysis system to objectively determine the quality and quantity of strikes in a fight. In one exemplary embodiment, one fighter wears a plurality of passive RFID tags at different locations that are read by a striking module (e.g., a knife) when the striking module lands on, or comes in proximity to, the fighter, to provide the location of a strike. Force sensors in the striking module enable determination of the type and force of a landed strike. A graphical user interface module displays information gathered by the fight analysis system.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. Thus, for further understanding of the invention, reference can be made to the following detailed description, read in connection with the drawings in which.

DETAILED DESCRIPTION OF THE INVENTION

The invention is described with reference to several different embodiments, all of which are directed to providing fight analysis that can objectively determine the quality and quantity of strikes as well as simulating fights in a way that provides a more realistic assessment of a fight.

Figure 1:
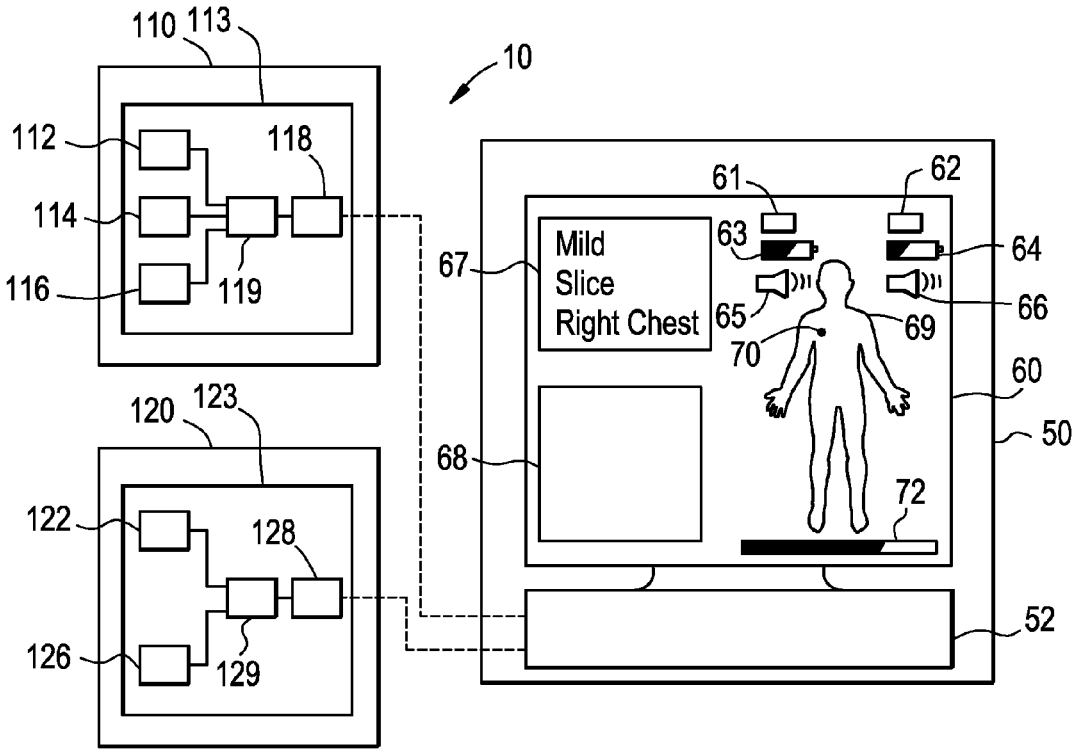
FIG. 1 is a block diagram of a fighting analysis system in one exemplary embodiment of the invention.

FIG. 1 is a block diagram of an exemplary fighting analysis system 10 in one exemplary embodiment of the invention. The main components of the fighting analysis system 10 can include without limitation a graphical user interface module 50, a striking module 110 and a receiving module 120 associated with each fighter. In general terms, the graphical user interface module 50 can communicate with the striking module 110 and the receiving module 120 of each fighter to configure the modules of the fighting analysis system 10 and to monitor the status of the fight by monitoring the status of those modules and the data and measurements generated by those modules. For simplicity, the exemplary fighting analysis system 10 is illustrated showing one fighter but can accommodate a plurality of fighters. In addition, for simplicity, the exemplary fighting analysis system 10 is illustrated showing a single striking module 110 and a single receiving module 120 associated with each fighter but can accommodate multiple modules for each fighter. Although many of the exemplary embodiments (i.e., protective devices such as a shirt 600, boxing glove 400, and chest protector 500) are described as either a striking module 110 or a receiving module 120, it will be understood that, in some cases, a protective device (e.g., a knee pad) may operate as both a striking module 110 and a receiving module 120.

In one embodiment, the graphical user interface module 50 can include without limitation a personal computer 52 running software for a graphical user interface display 60 to provide a visual indication of the status and activity associated with the fighters and the modules of the fighting analysis system 10. In other embodiments, the graphical user interface module 50 can include satellite or television broadcasts and databases for storing the information provided by the fighting analysis system 10.

For simplicity, the exemplary graphical user interface display 60 is shown as providing information about one fighter but can be modified to show information about multiple fighters. As shown in FIG. 1, the graphical user interface display 60 can also periodically check and display the connectivity status 61 of the striking module 110 and the connectivity status 62 of the receiving module 120 module to the graphical user interface module 50. The graphical user interface display 60 can also periodically check and display the battery status 63 of the striking module 110 and the battery status 64 of the receiving module 120 module (if batteries are used in those modules). The graphical user interface display 60 can also periodically check and display an indicator status 65 of the striking module 110 and an indicator status 66 of the receiving module 120 module. An exemplary indicator status 65, 66 would provide information on whether the striking module 110 or receiving module 120 was configured to provide an audible indication (e.g., buzzer) or visual indication (e.g., LED display) when a landed strike occurs.

The graphical user interface display 60 can also display the time, force (e.g., mild, moderate, severe), type (e.g., stab, slice), and location (e.g., right chest) of a strike landed on a fighter, allowing for the display of a description of the last landed strike 67 against a fighter as well as a running log 68 of the landed strikes against a fighter. It will be understood that the determination of forces in the present invention can be the actual forces or approximations or characterizations of the relative forces inflicted or received by a fighter. These strikes can also be displayed on a graphical representation 69 of a fighter, showing the location 70 of the landed strike. The software of the graphical user interface module 50 can analyze the data associated with these strikes landed on a fighter, including without limitation the time, force, type, and location of a strike, based on physiological data that can be used to predict the physical harm that would be caused by the strikes (e.g., amount of blood loss) to estimate the status of the health of a fighter that can be displayed in a health status bar 72. As a fighter experiences landed strikes, the health status bar 72 can continue to decrease until the fighter experiences enough landed strikes to result in the death of the fighter. The graphical user interface module 50 can also be used to analyze and playback the fight to provide further fight metrics and training to the fighters. This analysis can provide an objective determination of which fighter inflicted and received the most damage during the fight (e.g., based on the cumulative totals of landed strikes and the forces associated with those strikes).

In the block diagram of the exemplary fighting analysis system 10 shown in FIG. 1, the striking module 110 is the component that delivers a strike to another fighter and can be located on or part of, for example, weapons, fists, feet, elbows, knees, etc. or any other device or body part that can deliver a strike. The striking module can include a microcontroller 119 for determining various fight metrics based on information received from other components in the striking module 110 (e.g., the accelerometer 114, force sensor 116), operating other components in the striking module (e.g., indicator 112), and communicating with the wireless transceiver 118. In one embodiment, the microcontroller 119 can be mounted on a printed circuit board 113 that makes the connections between and provides the power to the other components in the striking module 110, which can be mounted to the printed circuit board 113. For some applications, it may be advantageous to use a microcontroller 119 with advanced signal processing capabilities (e.g., a digital signal processor (DSP)).

The striking module 110 can include an indicator 112 (e.g., a buzzer or LED display) to provide an audible indication or visual indication when a landed strike occurs. The indicator 112 can also provide a visual indication (e.g. and LED display) of the battery or connection status of the striking module 110. The striking module 110 can also include a wireless transceiver 118 (e.g., using BLUETOOTH, ZIGBEE, ANT, WIFI, LINX, GSM, or other proprietary communications techniques) for communicating with the graphical user interface module 50 to record data and track real-time use and performance of the fighting analysis system 10. For example, the wireless transceiver 118 can communicate the particular identification of the striking module 110, including identification of the fighter using the striking module 110, the time, force, type, and location of a strike landed by the striking module 110 on another fighter, and the connectivity status 61, battery status 63, and indicator status 65 of the striking module 110 to the graphical user interface module 50. The graphical user interface module 50 can communicate data and commands to the wireless transceiver 118 to configure the settings of the striking module 110, including without limitation the setting to turn on or off the indicator 112.

As shown in the block diagram of the exemplary fighting analysis system 10 shown in FIG. 1, the striking module 110 can include an accelerometer 114 to provide inertial sensing of the striking module to detect whether strikes are landed or missed as well as determine the force of landed strikes in real-time. In addition, the accelerometer 114 can also be used to detect whether a strike was blocked or to determine the speed or pattern of a practice or attempted strike. The accelerometer 114 is a device for measuring acceleration and can be used to calculate forces on objects. Single- and multi-axis (x, y, z) models can be used to detect magnitude and direction of the acceleration as a vector quantity (the direction of the acceleration along each independent axis ($A_X$, $A_Y$, $A_Z$)). This data can be captured for each individual axis or combined to get an overall magnitude. The output of the measured acceleration can be available as an analog value that can be converted by the microcontroller 119 and used to calculate force as well as other fight parameters, such as inclination, vibration, and shock. A software algorithm running on the microcontroller 119 can be used to calculate motion parameters, detect strikes (missed, landed, or blocked), detect the beginning and end of a strike, and determine the forces associated with landed strikes and provide this information in real-time. Since accelerometers 114 are typically small, they can be rigidly mounted in the striking module 110 and require a small amount of electrical power (e.g., 1.5 mA at 3V). A plurality of accelerometers 114 can be used in the striking module 110 depending on the particular configuration of the striking module 110.

Figure 6:
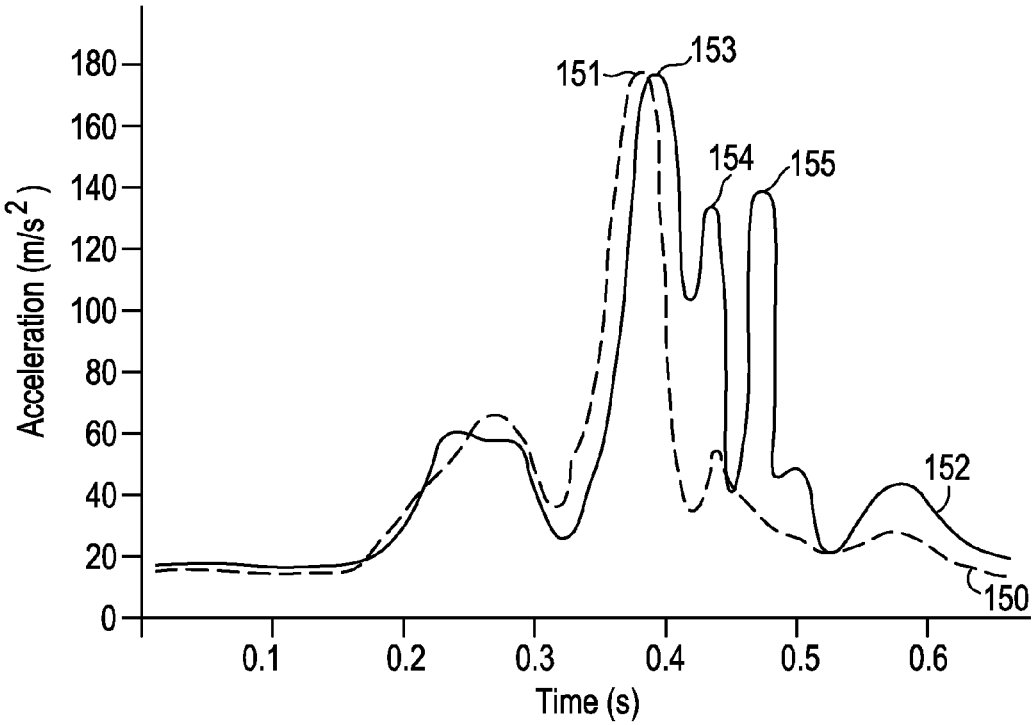
FIG. 6 illustrates the acceleration magnitude profiles of a landed strike and a missed strike in one exemplary embodiment of the invention.

In one exemplary embodiment, a three-axis (x, y, z), 8 g accelerometer 114 with an analog output can be used in a striking module 110 to detect whether a strike was landed or missed based on the difference in acceleration profiles between a landed strike and a missed strike. FIG. 6 illustrates exemplary acceleration magnitude profiles generated by an accelerometer 114 rigidly mounted on the wrist of a fighter (e.g., inside the wrist of a boxing glove) attempting to strike a heavy (punching) bag. In determining the acceleration magnitude profiles, $A_X$, $A_Y$, and $A_Z$ are the individual accelerations along each axis (x, y, z) and $A_M$ is the acceleration magnitude determined by the following equation:

$$A_M=\sqrt{A_X^2+A_Y^2+A_Z^2} \quad (1)$$

In FIG. 6, the acceleration magnitude for a landed strike $A_{ML}$ 150 shows a single prominent acceleration spike 151, which represents the first contact with the heavy bag (the first experiences a very quick deceleration at contact with the bag). A similar acceleration profile (i.e., a single defined spike) occurs during contact with a human body. In FIG. 6, the acceleration magnitude for a missed strike $A_{MM}$ 152 shows three prominent acceleration spikes 153, 154, 155, providing a bouncy profile. A comparison of the acceleration magnitude profiles of the landed strike $A_{ML}$ 150 and the missed strike $A_{MM}$ 152 demonstrates the different acceleration profiles for each, which can be analyzed by the microcontroller 119 to determine whether a strike was landed or missed.

In addition to detecting whether a strike was landed or missed, the accelerometer 114 can also provide data to determine the force of landed strikes. As demonstrated by the following equation (Newton's Second Law), the acceleration (A) of an object is directly related to the force (F) applied to the object and the mass of the object (m):

$$F=mA \quad (2)$$

Since it is also known that the forces between colliding objects are equal and opposite (Newton's Third Law), by capturing the acceleration (or deceleration) during a landed strike, the force of the landed strike can be determined with knowledge of the approximate mass (m) of the striking module 110 (e.g., a fighter's fist, a knife, a knife plus a hand). This mass (m) of the striking object can be input to the software of the microcontroller 119 as part of the initialization and setup of the fighting analysis system 10 and could be changed if the striking module 110 (or fighter) is changed. The forces of each landed strike can be transmitted by the wireless transceiver 118 to the graphical user interface module 50 for display on the graphical user interface display 60. In addition, the overall cumulative force sustained by a fighter during a fight can be determined and presented on the graphical user interface display 60.

In another embodiment of the invention, the accelerometer 114 can also be used to track the orientation, velocity, and path of a strike when used with additional hardware (e.g., a gyroscope). The orientation of the mounted accelerometer 114 can be determined when the accelerometer 114 is motionless by detecting the acceleration caused by gravity. Looking at the components of acceleration in each axis (x, y, z) will provide the required data to calculate how each axis is oriented compared to the pull of the earth's gravitation field. With the addition of gyroscopes, changes from the initial motionless orientation can potentially be tracked throughout a fight, including when strikes are landed. Changes in velocity can be calculated by integrating the acceleration measured by the accelerometer 114 for each axis over time. Each axis can be calculated independently to monitor the velocity in each axis. The individual velocity components can be combined to get a magnitude and direction (vector) of overall velocity.

$$\Delta v=\int a\cdot dt \quad (3)$$

Changes in position can be calculated by integrating the calculated velocity components determined from the accelerometer 114 over time. Each axis can be calculated independently to monitor the position in each axis.

$$\Delta x=\int v\cdot dt \quad (4)$$

Returning to the block diagram of the exemplary fighting analysis system 10 shown in FIG. 1, the striking module 110 can include a force sensor 116 to determine the force of landed strikes in real-time. Force sensors 116 are discrete sensors used to detect and measure force or pressure on a specified area, membrane, or actuator. In one embodiment, the output of the force sensor 116 (and any additional circuitry) can be available as an analog value that can be converted by the microcontroller 119 and used to calculate force as well as other fight parameters, such as the type of a landed strike. Because the forces are equal and opposite, determination of the force exerted on the striking module 110 can be used to determine the force inflicted on a fighter by the striking module 110. The microcontroller 119 can then communicate this information to the wireless transceiver 118 for transmission to the graphical user interface module 50. For example, the actual calculated force of a landed strike can be transmitted to the graphical user interface module 50 or a relative characterization of the force (mild, moderate, severe). A plurality of force sensors 116 can be used in the striking module 110 depending on the particular configuration of the striking module 110.

Figure 2:
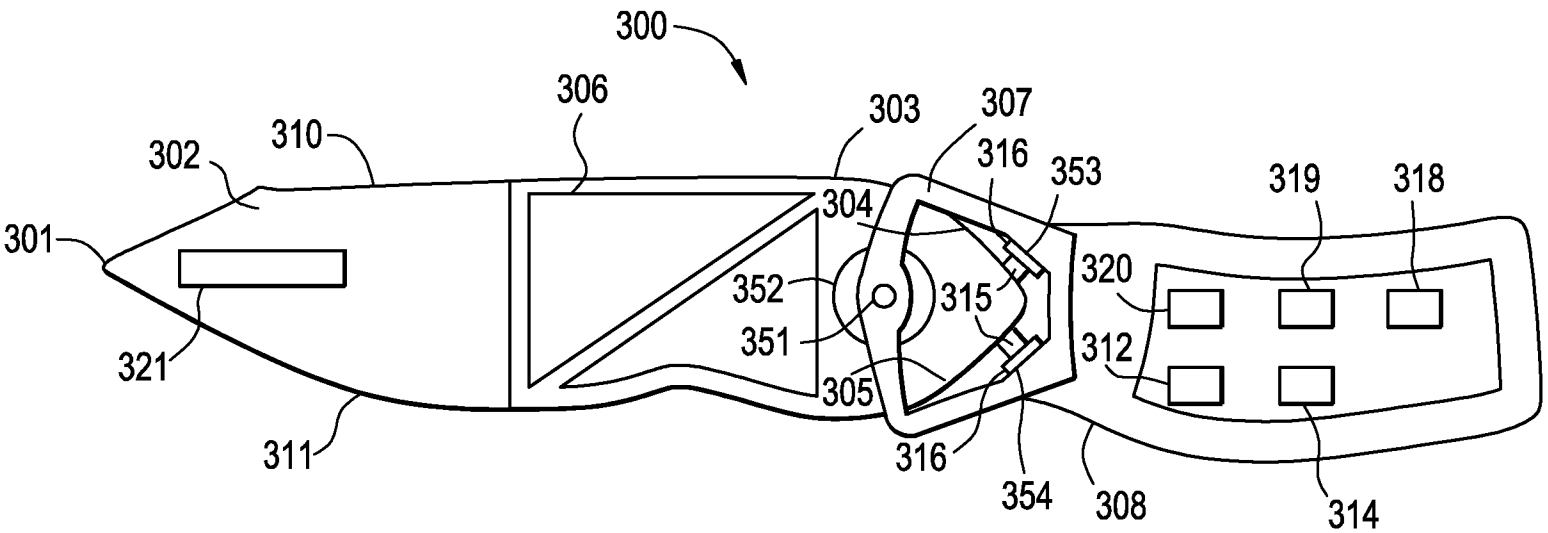
FIG. 2 illustrates a knife used as a striking module in one exemplary embodiment of the invention.

FIG. 2 illustrates a knife 300 used as a striking module 110 in one exemplary embodiment of the invention. Although this exemplary embodiment is described with reference to a knife 300, it will be understood that the inventive concepts can be applied to other weapons used in fighting (e.g., a sword, stick, three-section staff, nun chuck, wushu weapons). In one embodiment, the knife 300 can include a knife blade 302 enclosed by a rubbery cast urethane material that can be fairly soft and pliable to enhance the safety of the striking module 110. The knife blade 302 can also include a stiffening trellis 306 at the knife blade base 303 to provide a rigid mechanical mounting interface by which the knife blade 302 connects to the knife handle 308. The knife handle 308 can enclose one or more knife circuit boards 313 on which the electronics of the striking module 110 can be mounted. These electronic components can include without limitation, an indicator 312 (e.g., buzzer), an accelerometer 314, a wireless transceiver 318, and a microcontroller 319 as described previously. A rechargeable battery (not shown) for powering the electronics can also be enclosed in the knife handle 308. The indicator 312 can also provide a visual indication (e.g. and LED display) of the batter or connection status of the knife 300.

The knife handle 308 can also include a rigid handle structural backbone 307 to which the knife blade 302 and circuit boards 313 are attached. As shown in FIG. 2, the stiffening trellis 306 can be mounted to the rigid handle structural backbone 307 via a central pin 351 and bushings 352 about which the knife blade base 303 can pivot. The knife blade base 303 can pivot when force is exerted on the knife blade 302 (e.g., when the knife blade 302 lands on a fighter). When the knife blade 302 pivots, a first face 304 of the knife blade base 303 applies force on a first face 353 of the rigid handle structural backbone 307, and a second face 305 of the knife blade base 303 applies force on a second face 354 of the rigid handle structural backbone 307. To measure the forces applied by the knife blade base 303 on the rigid handle structural backbone 307 that can be used to determine the force exerted on the knife blade 302, which, as described earlier, should be equal and opposite to the force exerted by the knife blade 302 on a fighter, force sensors 316 can be installed on the first face 353 and second face 354 of the rigid handle structural backbone 307. In addition to pivoting, when force is exerted on the knife blade 302, the knife blade base 303 can also cause the bushing 352, which can be made from a compliant rubber or elastomeric material, to yield (e.g., be compressed and deformed) during a landed strike allowing for the knife blade base 303 to contact the force sensors 316. Once the strike is completed, the bushing 352 can rebound to return to its original shape and release from the force sensors 316.

In another embodiment, force concentration devices (e.g., pucks) 315 can be adhered to the surface of the force sensors 316 to interact directly with the first face 304 and the second face 305 of the knife blade base 303 or vice versa (i.e., force concentration devices 305 can be added to the first face 304 and the second face 305 of the knife blade base 303).

In the embodiment of the knife 300 shown in FIG. 2, the force sensors 316 can be force sensitive resistors or piezoresistive elements in which the sensing material's resistance changes under mechanical stress. This change can be used to calculate the mechanical stress on the membrane or actuator. In order to utilize force sensors 316 to detect and measure a relative change in force or applied load, detect and measure the rate of change in force, identify force thresholds and trigger appropriate action, and/or detect contact and/or touch, additional circuitry can be required to acquire the change in resistance at an applicable sampling rate and calculate the corresponding force.

In the embodiment of the knife 300 shown in FIG. 2 using two force sensors 316, the type of a landed strike (e.g., whether a strike was a stab or a slice or whether the top edge or bottom edge of the blade was used) can be determined by comparing the forces experienced by the two force sensors 316. For example, if both force sensors 316 experience the same amount of force, that would indicate that the type of strike was a stab with the knife blade tip 301 striking the fighter with a substantially perpendicular orientation. On the other hand, if the force sensor 316 on the knife blade top edge 310 experienced significantly more force than the force sensor 316 on the knife blade bottom edge 311, that would indicate that the type of strike was a slice with the knife blade bottom edge 311 striking the fighter.

Figure 4:
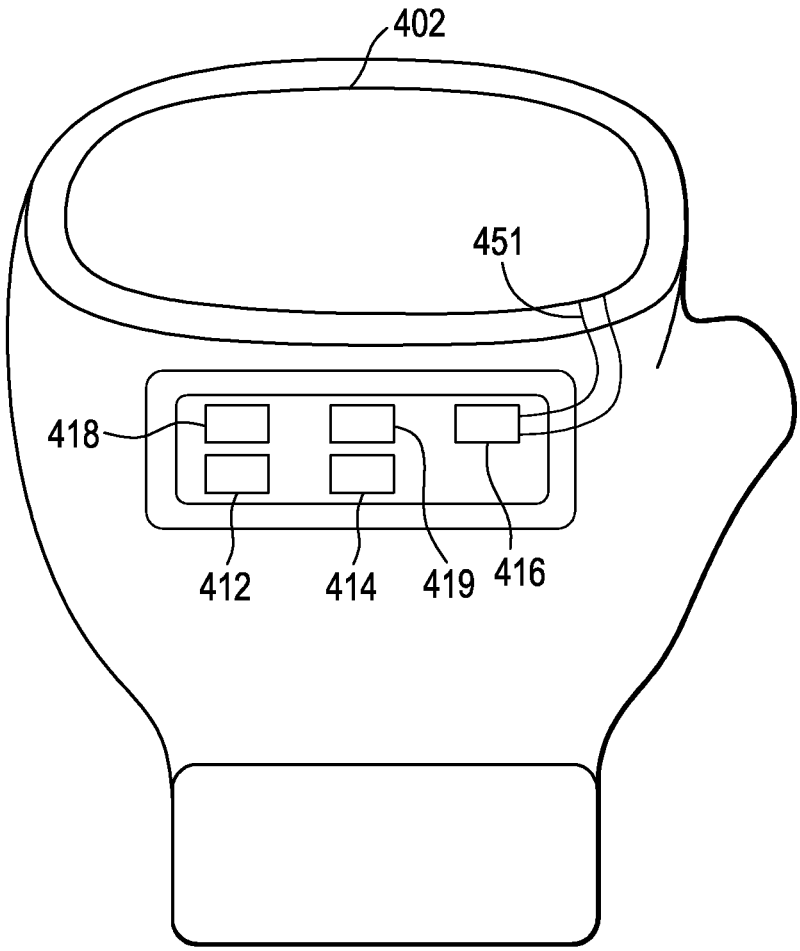
FIG. 4 illustrates a boxing glove used as a striking module in one exemplary embodiment of the invention.

FIG. 4 illustrates a boxing glove 400 used as a striking module 110 in one exemplary embodiment of the invention. In one embodiment, one or more fluid bladders 402 can be installed in or proximate to the portion of the boxing glove 400 that is most likely to make contact with the other fighter (e.g., the portion of the boxing glove 400 on top of the hand, knuckles, and the thumb). In this exemplary embodiment, the fluid bladder 402 contains air but can, in other embodiments, include liquid. The fluid bladder 402 can be installed along with or in lieu of conventional foam and padding typically used in boxing gloves 400. In some applications, the fluid bladder 402 can provide additional cushioning and protection to supplement or replace conventional foam and padding.

Given its location in the boxing glove 400, the fluid bladder 402 will be compressed, increasing the force (i.e., pressure) in the fluid bladder 402, when force is exerted on the boxing glove 400 (e.g., when the boxing glove 400 lands on a fighter). To measure the forces exerted on the boxing glove 400 that, as described earlier, should be equal and opposite to the force exerted by the boxing glove 400 on a fighter, a force sensor 416 in the form of a pressure sensor 416 (e.g., an absolute pressure sensor) can be installed in conjunction with the fluid bladder 402 to measure the change in pressure caused by a landed strike.

A pressure sensor 416 detects the pressure differences between the surrounding or inlet pressure and a sealed vacuum reference. This is accomplished by detecting the deflection (and strain) of a member between the inlet pressure and the reference pressure. This difference in pressure is amplified and output. The output is available as an analog value that can be converted by the microcontroller 419 and used to calculate the force. Since pressure sensors are typically small, they can be rigidly mounted in the striking module 110 (e.g., in the fluid bladder 402 or a printed circuit board 413) and require a small amount of electrical power. In one embodiment shown in FIG. 4, the pressure sensor 416 can be located remotely from the fluid bladder 402, which would require tubing 451 to convey pressure changes in the fluid bladder 402 to the pressure sensor 416. In another embodiment (not shown), the pressure sensor 416 can be embedded in the fluid bladder 402, which would require wiring to and from the fluid bladder 402 to bring power and communicate the pressure measurements (e.g., voltage measurements) from the pressure sensor 416 to the microcontroller 419.

In a typical boxing glove 400, there is little to no padding on the underside (palm) of the hand, which is protected from damage as it is not contacted during fighting. In one embodiment, this area of the boxing glove 400 can enclose one or more circuit boards 413 on which the electronics of the striking module 110 can be mounted. These electronic components can include without limitation, an indicator 412 (e.g., buzzer), an accelerometer 414, a wireless transceiver 418, and a microcontroller 419 as described previously. A rechargeable battery (not shown) for powering the electronics can also be enclosed in this area of the boxing glove 400. The indicator 412 can also provide a visual indication (e.g. and LED display) of the battery or connection status of the boxing glove 400.

In another embodiment (not shown), the electronics of the striking module 110 can be located remotely from the striking module 110 if there is insufficient space or no safe place in the striking module 110 (e.g., in a forearm pad connected to the striking module 110).

Figure 7:
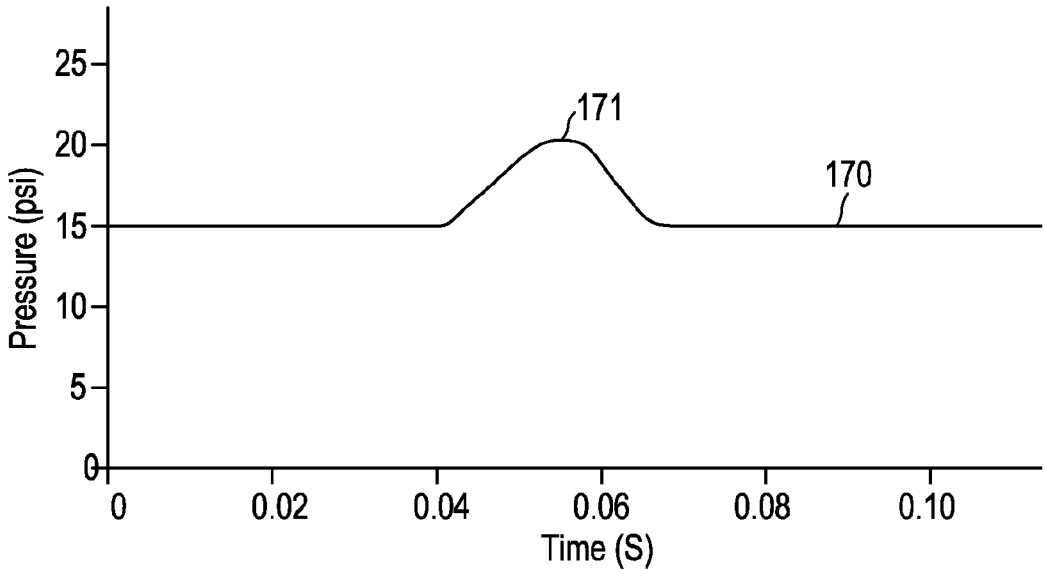
FIG. 7 illustrates a pressure profile generated by a pressure sensor installed in conjunction with a fluid bladder in a boxing glove in one exemplary embodiment of the invention.

In one exemplary embodiment, a pressure sensor 416 can detect whether a strike was landed based on a change in the pressure sensed by the pressure sensor 416 before/after and during a landed strike. FIG. 7 illustrates an exemplary pressure profile 170 generated by a pressure sensor 416 installed in conjunction with the fluid bladder 402 in a boxing glove in one exemplary embodiment of the invention. As shown in FIG. 7, a significant change of the pressure inside the fluid bladder 402 demonstrated by a pressure spike 171 indicates a landed strike and provides the start and stop times for the strike.

In addition to detecting whether a strike was landed or missed, the pressure sensor 416 can also provide data to determine the force of landed strikes. When force is applied to the fluid bladder 402, the pressure changes in an amount proportional to the force applied divided by the area on which the force is applied. Accordingly, the force of landed strike can be determined by multiplying the change in pressure ($\Delta p$) by the force contact area (A) of the fluid bladder 402 during the strike.

$$F=\Delta p\cdot A \tag{5}$$

Figure 8:
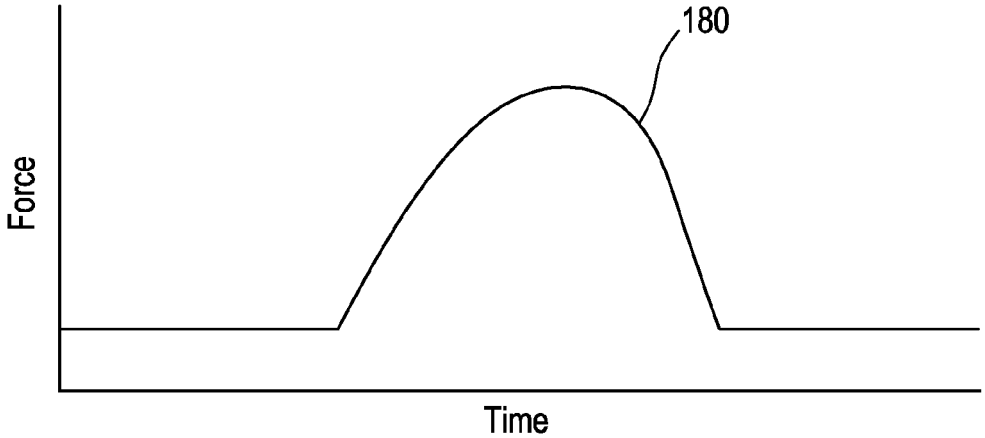
FIG. 8 illustrates a force profile generated by combining consecutive force samples to create a plot of force versus time for a landed strike in one exemplary embodiment of the invention.

Given this relationship between force (F) and pressure (p), the maximum force for a landed strike can be determined with knowledge of the maximum change in pressure measured by the pressure sensor 416 during the landed strike and the force contact area (A) of the fluid bladder 402 during the strike. In addition to determining the maximum force, the instantaneous force at a particular time can be determined with knowledge of the change in pressure measured by the pressure sensor 416 at that time and the force contact area (A) of the fluid bladder 402. FIG. 8 illustrates an exemplary force profile 180 generated by combining consecutive force samples (i.e., instantaneous force measurements) to create a plot of force versus time for a landed strike. This force profile 180 provides information on the duration of the landed strike and how the force changed over time during the strike. In addition, the impulse (I) can be calculated from the area under the force-time curve since the impulse is equal to the change in momentum ($p_m$) which is equal to the mass times the change in velocity $$I=\int F\cdot dt=\Delta p_m=m\Delta v \tag{6}$$

In one embodiment, the use of multiple fluid bladders 402 in the boxing glove 400, each associated with pressure sensor 416 in a way where the microcontroller 419 can determine the force exerted on a particular fluid bladder 402 by a landed strike (e.g., if each fluid bladder 402 was associated with its own pressure sensor 416.) This can improve the detail of the information provided about a landed strike and how it was landed (e.g., a punch where most of the force was inflicted by the thumb is less effective where most of the force was delivered by the knuckles).

Returning to the block diagram of the exemplary fighting analysis system 10 shown in FIG. 1, the receiving module 120 is the component that receives a landed strike from the striking fighter and can be located on or part of the clothing or protective gear worn by the receiving fighter. Like the striking module 110, the receiving module 120 can include an indicator 122 (e.g., a buzzer or LED display) to provide an audible indication or visual indication when a landed strike occurs, and a wireless transceiver 128 for communicating with the graphical user interface module 50 to record data and track real-time use and performance of the fighting analysis system 10. For example, the wireless transceiver 128 can communicate the particular identification of the receiving module 120, including identification of the fighter using the receiving module 120, the time, force, type, and location of a strike landed on the receiving module 120, and the connectivity status 62, battery status 64, and indicator status 66 of the receiving module 120 to the graphical user interface module 50. The graphical user interface module 50 can communicate data and commands to the wireless transceiver 128 to configure the settings of the receiving module 120, including without limitation the setting to turn on or off the indicator 122.

Returning to the block diagram of the exemplary fighting analysis system 10 shown in FIG. 1, the receiving module 120 can include a force sensor 126 to determine the force of landed strikes in real-time. As was the case with the striking module 110, the output of the force sensor 126 (and any additional circuitry) can be available as an analog value that can be converted by the microcontroller 129 and used to calculate force as well as other fight parameters. The microcontroller 129 can then communicate this information to the wireless transceiver 128 for transmission to the graphical user interface module 50. For example, the force of a landed strike can be transmitted to the graphical user interface module 50. A plurality of force sensors 126 can be used in the receiving module 120 depending on the particular configuration of the striking module 120.

Figure 5:
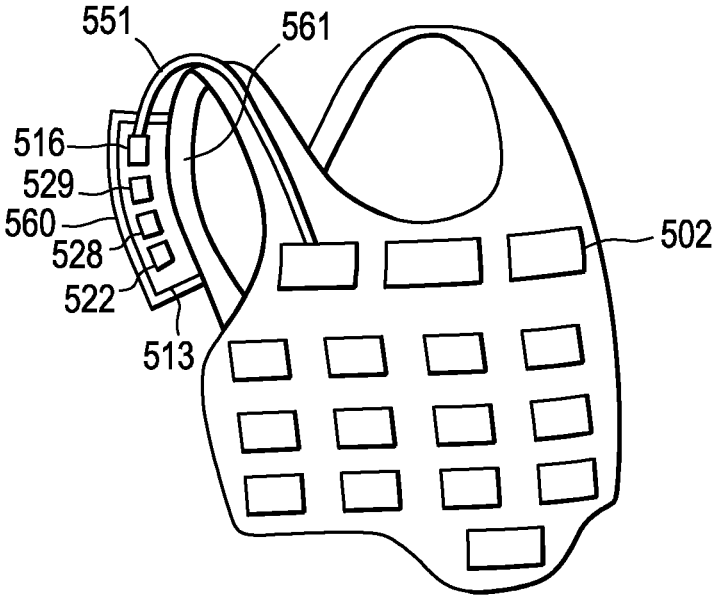
FIG. 5 illustrates a chest protector used as a receiving module in one exemplary embodiment of the invention.

FIG. 5 illustrates an exemplary chest protector 500 used as a receiving module 120 in one exemplary embodiment of the invention. In one embodiment, one or more fluid bladders 502 can be installed in or proximate to the portion of the chest protector 500 that is most likely receive landed strikes from the other fighter. In this exemplary embodiment, the fluid bladders 502 contain air but can, in other embodiments, include liquid. The fluid bladder 502 can be installed along with or in lieu of conventional foam and padding typically used in chest protectors 500 or other protective gear. In some applications, the fluid bladder 502 can provide additional cushioning and protection to supplement or replace conventional foam and padding.

Given its location in chest protector 500, the fluid bladder 502 will be compressed, increasing the pressure in the fluid bladder 502, when force is exerted on the chest protector 500 (e.g., when a strike lands on a fighter). To measure the forces exerted on the chest protector 500 that, as described earlier, should be equal and opposite to the force exerted by striking object, a force sensor 516 in the form of a pressure sensor 516 (e.g., an absolute pressure sensor) can be installed in conjunction with the fluid bladder 502 to measure the change in pressure caused by a landed strike. In one embodiment shown in FIG. 5, the pressure sensor 516 can be located remotely from the fluid bladder 502, which would require tubing 551 to convey pressure changes in the fluid bladder 502 to the pressure sensor 516. In another embodiment (not shown), the pressure sensor 516 can be embedded in the fluid bladder 502, which would require wiring to and from the fluid bladder 502 to bring power and communicate the pressure measurements (e.g., voltage measurements) from the pressure sensor 516 to the microcontroller 519. As described with respect to the striking module, the pressure sensor 516 can detect whether a strike was landed, the start and stop times of a landed strike, and the force and impulse of a landed strike.

In one embodiment, a protective case 560 located on a chest protector straps 561 can enclose one or more circuit boards 513 on which the electronics of the receiving module 110 can be mounted. These electronic components can include without limitation, an indicator 512 (e.g., buzzer), a wireless transceiver 518, and a microcontroller 519 as described previously. A rechargeable battery (not shown) for powering the electronics can also be enclosed in this protective case 560. The indicator 512 can also provide a visual indication (e.g. and LED display) of the battery or connection status of the chest protector 500.

In one embodiment, multiple fluid bladders 502 can be used in the chest protector 500, each associated with a pressure sensor 516 in a way where the microcontroller 519 can determine the force exerted on a particular fluid bladder 502 by a landed strike (e.g., if each fluid bladder 502 was associated with its own pressure sensor 516). This can improve the detail of the information provided about a landed strike and the location where it was landed (e.g., confirming that a strike was landed on the upper right side of the chest rather than only that the landed strike landed somewhere on the chest protector 500).

In another embodiment, Radio Frequency Identification (RFID) technology can be used to provide information about the location of a landed strike. RFID is an automatic identification method that stores and remotely retrieves data using devices called RFID tags or transponders. The technology requires some cooperation of an RFID reader and an RFID tag. RFID tags can be active (requiring a battery to operate) or passive (no battery is required; power is harvested from the reader's transmitted radio waves). The RFID tags come in a variety of sizes and configurations, including those shaped like and the size of a credit card. Each RFID tag can have a unique identification that is detectable by the RFID reader when the RFID reader is within a given distance of the tag. The RFID reader can have an antenna that emits radio waves; the RFID tag responds by sending back its data. The frequency used for identification, the RFID reader antenna gain, the orientation and polarization of the RFID reader antenna and the RFID tag antenna, as well as the placement of the RFID tag on the object to be identified will all have an impact on the RFID system's read range.

Returning to the exemplary knife 300 used as a striking module 110 in one exemplary embodiment of the invention illustrated in FIG. 2, the knife blade 302 can also include an RFID reader 320 for transmitting and receiving RFID signals to and from an RFID antenna 321. The RFID reader 320 can be connected to the microcontroller 319 to communicate data between the two devices, including the identification of any RFID tags 602 read by the RFID reader 320. These identifications of the RFID tags 602 can then be transmitted to the graphical user interface module 50 using the transceiver 318. The graphical user interface module 50 can associate the particular RFID tag 602 with its location to provide the location of the landed strike.

Figure 3:
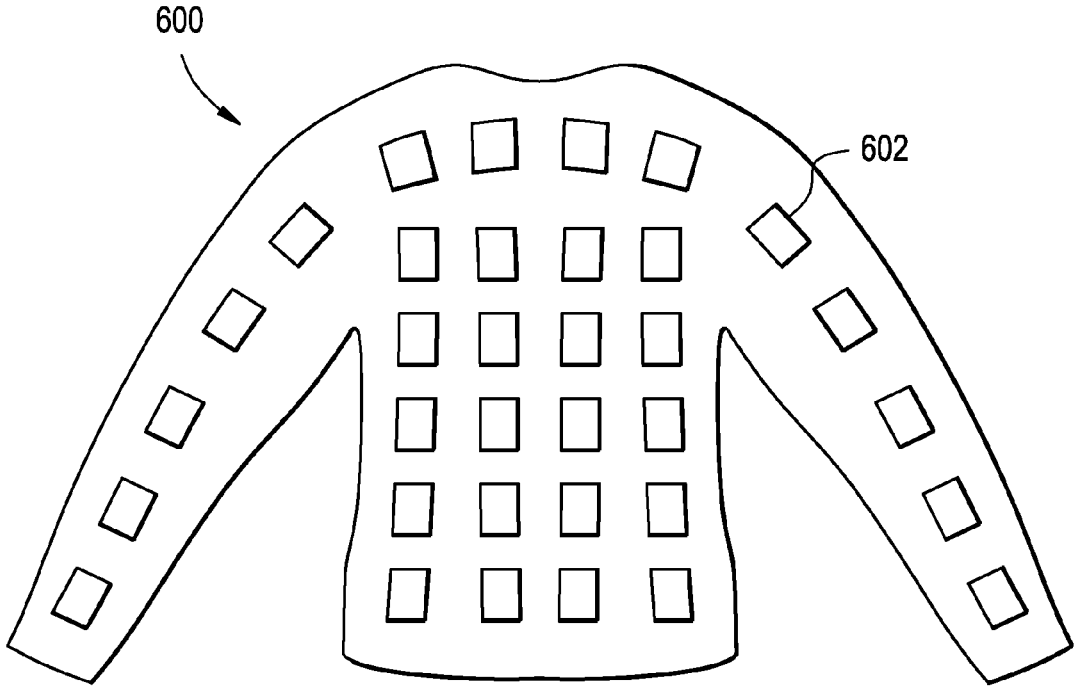
FIG. 3 illustrates a garment used as a receiving module in one exemplary embodiment of the invention.

FIG. 3 illustrates an exemplary garment 600 that can be used as a receiving module 120 to work in conjunction with the RFID equipment in the knife 300 in one exemplary embodiment of the invention. Although this exemplary RFID embodiment is described with reference to a garment 600 in the form of a shirt, it will be understood that the inventive concepts can be applied to other garments (e.g., pants, shoes). As illustrated in FIG. 3, one or more RFID tags 602 are mounted in various locations of the garment 600, each representing an individual location of the body of the fighter wearing the garment 600. The RFID tags 602 can be passive devices not requiring batter power to operate and therefore not requiring any wiring in the garment 600. When the RFID antenna 321 of the knife 300 is placed in proximity to an RFID tag 602, the RFID tag 602 is energized and its antenna transmits its identification to the RFID antenna 321 and RFID reader 320 in the knife 300. Within the limits of available technology, the read range of the RFID system can be adjusted to ensure that the RFID tag 602 is read by the RFID reader 320 only when the knife 300 comes within a certain distance of the tag 602, simulating a landed strike. This read range can be affected by a number of factors, including the frequency used for identification (e.g., the lower the frequency, lower the range), the gain of the RFID antenna 321, the orientation and polarization of the RFID antenna 321 of the RFID reader 320 and RFID tag 602, the size of the RFID tag 602 (the larger the tag, the larger the read range). In one embodiment, the read range can be small enough (e.g., 4 cm) to avoid detecting too many RFID tags 602 on a landed strike and the read rate can be fast enough (e.g., 30 tags read per second) to avoid missing landed strikes as the striking module 110 moves across the receiving module 120. Also, the number or density of RFID tags 602 installed in a garment 600 can determine the resolution of the system as well as the acceptable read range (i.e., with more RFID tags 602 installed, a more precise location can be provided, but a smaller read range can be required to avoid reading too many RFID tags 602).

In one embodiment, the RFID antenna 321 and RFID reader 320 in the knife 300 can be configured to continuously scan for RFID tags 602 and report the location of, e.g., a landed strike (confirmed by a force sensor) or near miss, when the RFID antenna 321 comes in close proximity to an RFID tag 602. In another embodiment, the RFID antenna 321 and RFID reader 320 in the knife 300 can be configured to scan for RFID tags 602 and report the location of an RFID tag 602 when a force sensor 316 has confirmed the occurrence of a landed strike.

In addition to reading the identification of the RFID tags 602 to determine the location of a landed strike, the RFID reader 320 of the knife 300 can also be used to configure the fighting analysis system 10 to link a particular RFID tag 602 to a particular part of the body of a fighter. For example, if an RFID tag 602 is installed on the left bicep of the garment 600, the graphical user interface module 50 can communicate data and commands to the knife 300 to read the identification of that RFID tag 602 and assign it to the "left bicep."

This written description uses examples to disclose the invention, including the best mode, and also to enable any person skilled in the art to make and use the invention. For example, although the exemplary embodiments are described with reference to a boxing glove 400 and chest protector 500, it will be understood that the inventive concepts can be applied to other offensive and/or or defensive gear used in fighting (helmets, headgear, shirts, protective pads/guards for feet, shins, knees, elbows, forearms, shorts, pants). The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fight analysis system comprising:

a receiving module comprising a plurality of passive radio frequency identification (RFID) tags, wherein said receiving module is a garment, said passive RFID tags are mounted in a plurality of locations of the garment, and each of said passive RFID tags has an identification that is associated with the location of the respective one of said passive RFID tags;

a striking module comprising a striking module force sensor for determining the force of a landed strike when said striking module contacts a fighter, an RFID reader for detecting one of said passive RFID tags located on said receiving module when said striking module is placed in proximity to said one of said passive RFID tags, and a wireless transceiver for transmitting information from said striking module, said information comprising said force of said landed strike and said identification of said one of said passive RFID tags detected by said striking module; and a graphical user interface module for receiving said information from said striking module wireless transceiver and displaying said force of said landed strike and said location of said one of said passive RFID tags detected by said striking module;

wherein each of said plurality of passive RFID tags is adapted to harvest power from radio waves transmitted by said RFID reader.

2. The fight analysis system of claim 1, wherein said striking module is a knife.

3. The fight analysis system of claim 1, wherein the striking module is a boxing glove.

4. The fight analysis system of claim 1, wherein said striking module further comprises an accelerometer for detecting whether strikes are landed, blocked, or missed.

5. The fight analysis system of claim 1, wherein said one of said passive RFID tags is detected when said striking module is placed within 4 cm of said one of said passive RFID tags.

6. The fight analysis system of claim 1, wherein said striking module further comprises a blade, wherein the base of said blade pivots during a landed strike to apply force on said force sensor, which comprises a plurality of force sensitive resistors located at said base of said blade, and wherein the type of landed strike can be determined by comparing the forces experienced by said force sensitive resistors.

7. The fight analysis system of claim 1, wherein said graphical user interface module further displays the status of the health of the fighter based on said force and said location of said landed strikes using physiological data to predict the effect of said landed strikes.

8. A fight analysis system comprising:

a receiving module comprising a plurality of passive radio frequency identification (RFID) tags, wherein said receiving module is a garment, said passive RFID tags are mounted in a plurality of locations of the garment, and each of said passive RFID tags has an identification that is associated with the location of the respective one of said passive RFID tags;

a striking module comprising an RFID reader for detecting one of said passive RFID tags located on said receiving module when said striking module is placed in proximity to said one of said passive RFID tags, and a wireless transceiver for transmitting information from said striking module, said information comprising said identification of said one of said passive RFID tags detected by said striking module; and a graphical user interface module for receiving said information from said striking module wireless transceiver and displaying said location of said one of said passive RFID tags detected by said striking module;

wherein each of said plurality of passive RFID tags is adapted to harvest power from radio waves transmitted by said RFID reader.

9. The fight analysis system of claim 8, wherein said striking module is a knife.

10. The fight analysis system of claim 8, wherein the striking module is a boxing glove.

11. The fight analysis system of claim 8, wherein said striking module further comprises an accelerometer for detecting whether strikes are landed, blocked, or missed.

12. The fight analysis system of claim 8, wherein said one of said passive RFID tags is detected when said striking module is placed within 4 cm of said one of said passive RFID tags.

13. A fight analysis system comprising:

a receiving module comprising a plurality of passive radio frequency identification (RFID) tags, wherein said receiving module is a garment, said passive RFID tags are mounted in a plurality of locations of the garment, and each of said passive RFID tags has an identification that is associated with the location of the respective one of said passive RFID tags; and a striking module comprising an RFID reader for detecting one of said passive RFID tags located on said receiving module when said striking module is placed in proximity to said one of said passive RFID tags, and a wireless transceiver for transmitting information from said striking module, said information comprising said identification of said one of said passive RFID tags detected by said striking module;

wherein each of said plurality of passive RFID tags is adapted to harvest power from radio waves transmitted by said RFID reader.

14. The fight analysis system of claim 13, wherein the striking module further comprises a striking module force sensor for determining the force of a landed strike when said striking module contacts a fighter, and the information from said striking module further comprises said force of said landed strike.

15. The fight analysis system of claim 13, wherein said striking module is a knife.

16. The fight analysis system of claim 13, wherein the striking module is a boxing glove.

17. The fight analysis system of claim 13, wherein said striking module further comprises an accelerometer for detecting whether strikes are landed, blocked, or missed.

18. The fight analysis system of claim 13, wherein the striking module further comprises an audible indicator or visual indicator to provide an indication of the landed strike.

19. The fight analysis system of claim 13, wherein said striking module further comprises a blade, wherein the base of said blade pivots during a landed strike to apply force on said force sensor, which comprises a plurality of force sensitive resistors located at said base of said blade, and wherein the type of landed strike can be determined by comparing the forces experienced by said force sensitive resistors.

* * * * *